US009717346B2

(12) United States Patent
Amritt

(10) Patent No.: US 9,717,346 B2
(45) Date of Patent: Aug. 1, 2017

(54) AUTOMATED REFLECTIVE DEVICE FOR MONITORING A BABY IN A BASSINET

(71) Applicant: Sarah H Amritt, Miami, FL (US)

(72) Inventor: Sarah H Amritt, Miami, FL (US)

( * ) Notice: Subject to any disclaimer, the term of this patent is extended or adjusted under 35 U.S.C. 154(b) by 183 days.

(21) Appl. No.: 14/734,346

(22) Filed: Jun. 9, 2015

(65) Prior Publication Data

US 2016/0363295 A1 Dec. 15, 2016

(51) Int. Cl.

| | |
|---|---|
| ***A45D 42/10*** | (2006.01) |
| ***F21V 21/088*** | (2006.01) |
| ***A47D 15/00*** | (2006.01) |
| ***F21V 33/00*** | (2006.01) |
| *F21W 131/302* | (2006.01) |

(52) U.S. Cl.

CPC ..... *A47D 15/00* (2013.01); *F21V 21/088* (2013.01); *F21V 33/004* (2013.01); *F21W 2131/302* (2013.01)

(58) Field of Classification Search

CPC . A47D 15/00; F21S 9/02; F21V 17/02; F21V 21/088; F21V 33/004; F21W 2131/302; A47G 1/02; A45D 42/10

See application file for complete search history.

(56) References Cited

U.S. PATENT DOCUMENTS 5,453,915 A * 9/1995 Bradley, III ..... A45D 42/16 248/474
6,039,455 A * 3/2000 Sorenson ..... B60R 1/008 248/479
6,485,154 B1 * 11/2002 Nolan-Brown ..... B60R 1/008 359/872
6,769,952 B1 * 8/2004 Drosendahl ..... A63H 33/006 446/227
7,222,977 B1 * 5/2007 Darling ..... A63H 33/22 359/839
9,089,781 B1 * 7/2015 Bush ..... A63G 33/00
2003/0086191 A1 * 5/2003 Nielsen ..... B60N 2/4876 359/877
2007/0058039 A1 * 3/2007 Clark ..... A63H 33/006 348/143
2009/0073678 A1 * 3/2009 Sherer ..... F21S 6/001 362/147

* cited by examiner

*Primary Examiner* — Peggy Neils
(74) *Attorney, Agent, or Firm* — Ruben Alcoba, Esq.

(57) ABSTRACT

An automated reflective device for monitoring a baby in a bassinet enables viewing the interior of a bassinet, such as a baby, from an outside vantage point. A clamp detachably attaches the device to a mounting surface on the bassinet. The device includes a reflector that is oriented in a horizontal, vertical, swiveling, and telescoping direction to provide an optimal line of site into the bassinet. The reflector has a housing and a reflective panel made of a non-glass substrate overlaid with a reflective coating. The reflective panel is oriented in relation to the bassinet, so as to reflect the interior contents of the bassinet from an external vantage point. A motor powers an actuator in the housing. The actuator adjustably moves the reflector. An LED illuminates a cool-white light inside the bassinet and on the reflective surface for enhanced viewing. A remote control operates the actuator and LED.

19 Claims, 6 Drawing Sheets

AUTOMATED REFLECTIVE DEVICE FOR MONITORING A BABY IN A BASSINET

BACKGROUND

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

The present invention is directed to an automated device for monitoring a baby in a bassinet enables viewing the interior of a bassinet, such as a baby, from an outside vantage point. A clamp detachably attaches the device to a mounting surface on the bassinet. The device includes a reflector that is oriented in a horizontal, vertical, swiveling, and telescoping direction to provide an optimal line of site into the bassinet.

It is known that a mirror is a generally planar surface that reflects light in such a way that, for incident light in some range of wavelengths, the reflected light preserves many or most of the detailed physical characteristics of the original light. It is also known that a bassinet is a portable bed specifically for babies from birth to about four months.

The inventor is a mother whom often placed her baby in a bassinet. When the mother placed her baby in the bassinet, the inventor recognized a problem. The problem was that when the bassinet was positioned distally, it was not always easy for her to look inside the bassinet, thereby preventing her from seeing her baby, which in turn caused her emotional distress.

Through additional research, the inventor learned that a mirror could be used to reflect the light from the baby to enable viewing of the baby inside the bassinet. The inventor duct taped a mirror to the edge of the bassinet, so that the baby could be viewed from an external vantage point. This worked for some time, and every time the bassinet was moved, the mirror required readjustment, along with removing and reapplying the duct taped.

The inventor decided to research for a more convenient way to reorient the mirror. The inventor learned that an actuator, as those used in side mirrors of vehicles, performed horizontal, vertical, and swiveling movements. The inventor decided to attach the mirror to the actuator. A motor was added to automate the movements.

The inventor was still not happy with having to walk over to the bassinet to adjust the mirror. This was especially inconvenient while sleeping in bed. The inventor decided to make operation of the actuator remotely operable. The inventor added a receiver near the mirror that operatively connected to the actuator. A remote control transmitted a signal that communicated to the receiver for operation of the actuator.

The inventor further decided to add lighting that would shine on the baby inside the bassinet and the mirror. The lighting would enhance the view, especially at night. Through trial and error, the inventor learned that an LED light emitted a cool-white light that did not disperse too much heat, and did not consume excessive energy from the limited battery. The inventor finally operatively connected the LED to the receiver, so that it too was controlled by the remote control.

For the foregoing reasons, there is an automated reflective device for monitoring a baby in a bassinet through a remotely operated adjustable reflector.

Baby monitoring systems and adjustable mirrors have been utilized in the past; yet none with the characteristics of the present invention. See U.S. Pat. Nos. 1,031,075; 5,103,347; and 20040266312.

For the foregoing reasons, there is automated device for monitoring a baby in a bassinet enables viewing the interior of a bassinet, such as a baby, from an outside vantage point. A clamp detachably attaches the device to a mounting surface on the bassinet. The device includes a reflector that is oriented in a horizontal, vertical, swiveling, and telescoping direction to provide an optimal line of site into the bassinet.

SUMMARY

The present invention describes an automated reflective device for monitoring a baby in a bassinet. The automated device for monitoring a baby in a bassinet, hereafter, "device", enables viewing the interior contents of a bassinet, i.e., baby, from an outside vantage point. The device may be remotely oriented in a swiveling, lateral, and vertical direction to provide the optimal line of site into the bassinet.

In some embodiments, the device includes a reflector that detachably attaches to the bassinet. A clamp may be used to attach to a mounting surface on the bassinet, such as the edges or head cover. A handle extends between the clamp and the reflector. The handle may be linear or jointed for enabling additional reorientation and adjustability for the reflector. The reflector may include a housing and a reflective panel. The housing contains motorized components for enabling automated orientation of the reflector. Since the reflective panel is not a mirror, it is generally not prone to breakage.

The reflector is oriented in relation to the bassinet, so as to reflect the interior contents of the bassinet for viewing from an external vantage point. Those skilled in the art will recognize that this external observation capacity is important because often, the line of site directly into the bassinet is restricted by an object or the bassinet itself. For example, a viewer sitting five feet from the bassinet cannot peer into the bassinet, but does have a straight line of site to the reflector. The reflector is thus oriented at an angle, so as to reflect the baby inside the bassinet.

A light emitting diode (LED) illuminates a cool-white light onto the reflector and the interior of the bassinet to enhance visibility of the reflection. The LED is configured to generate nominal heat, which may disturb the baby or ignite a fire. The LED also consumes minimal energy, such that the power source does not expire excessively fast.

To achieve the optimal line of site from outside the bassinet, the system utilizes an actuator that is disposed inside the housing of the reflector. A small electric motor powers the actuator. The actuator is configured to manipulate the reflector in multiple orientations. The actuator may include, without limitation, a geared motor, a Bowden cable, a gear, a lever, and a ball and socket.

In one embodiment, the actuator moves the reflector in a vertical, or up and down direction. In another embodiment, the actuator moves the reflector in a horizontal, or left and right direction. In yet another embodiment, the actuator swivels the reflector, which may include a 360° rotational direction. In one alternative embodiment, that may or may not be used, the actuator moves the reflector telescopically in an outward and inward direction. In this manner, the reflector may be oriented at multiple angles to obtain the desired line of site into the bassinet.

The device includes a remote control that remotely controls movement of the actuator. The remote control also operates the LED and powers on and off the device. The remote control has a transmitter that transmits a signal to a receiver in the housing. The receiver is operatively connected to the actuator and the light emitting diode. The signal is operable to command movement of the actuator, illumination of the LED, and powering on and off of the device.

One objective of the present invention is to provide an adjustable reflector that enables viewing inside a bassinet from an external line of sight.

Another objective of the present invention is to provide a clamp that is biased to exert an inward force for secure fastening to the bassinet.

Another objective of the present invention is to provide a reflective panel that is made from a non-glass substrate that does not break.

Yet another objective of the present invention is to provide an LED that emits a cool-white light, such that excessive heat is not generated proximal to a baby in the bassinet.

Yet another objective is to provide an LED that does not consume excessive power from the battery.

Yet another objective is to provide an electric motor for powering the actuator.

Yet another objective is to remotely operate the actuator and the LED.

Yet another objective is to provide an inexpensive device for monitoring the inside of a bassinet that does not utilize expensive, complex components, and is thus, inexpensive to manufacture.

DRAWINGS

These and other features, aspects, and advantages of the present invention will become better understood with regard to the following description, appended claims, and drawings where:

FIG. 5A is a rear view, and FIG. 5B is a front view, in accordance with an embodiment of the present invention;

Figure 6A:
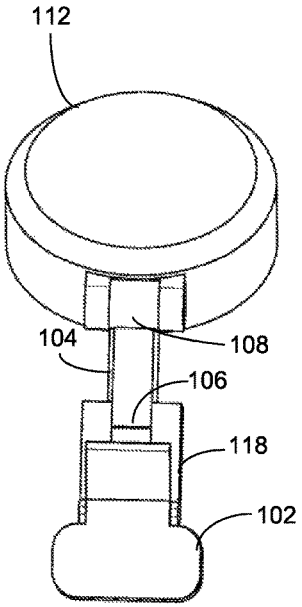
Figure 6B:
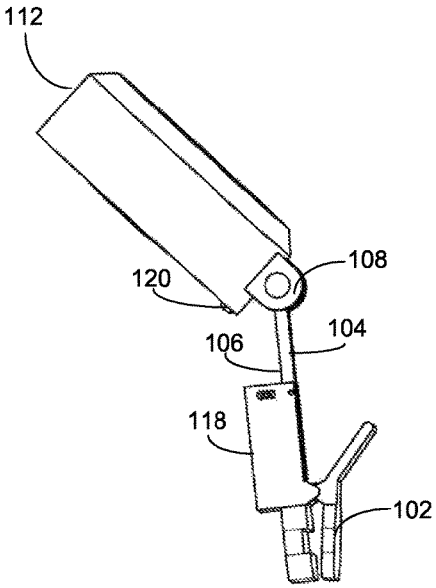
Figure 6C:
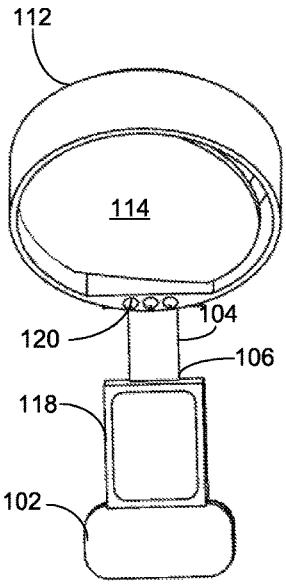
Figure 7A:
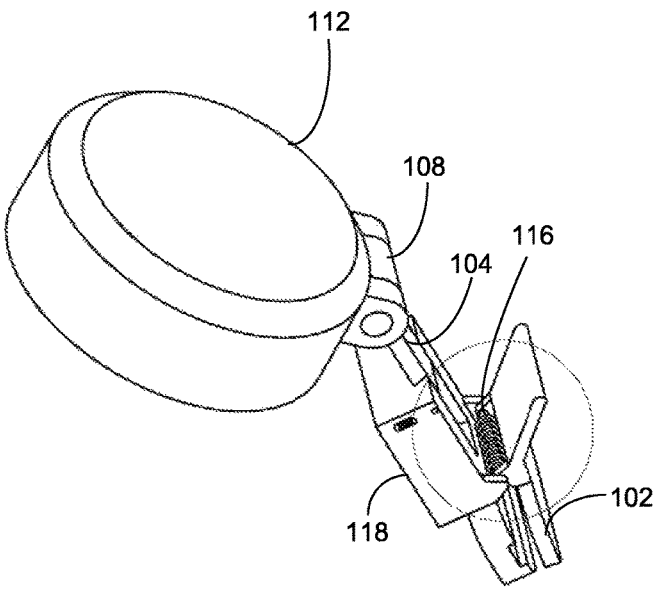
Figure 7B:
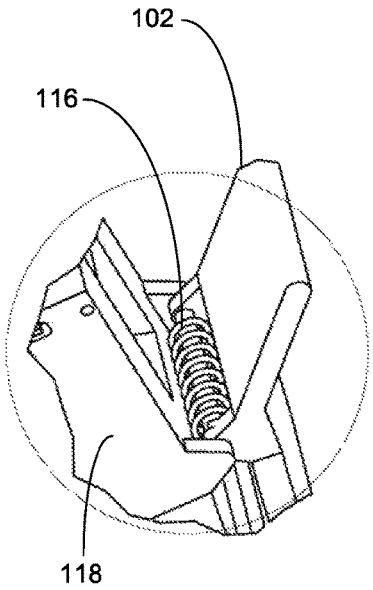

FIGS. 6A, 6B, and 6C are perspective views of the automated reflective device with an exemplary handle extended and an exemplary reflect end pivoted, where FIG. 6A is a rear view, FIG. 6B is a side view, and FIG. 6C is a front view, in accordance with an embodiment of the present invention; and FIGS. 7A and 7B are perspective views of the automated reflective device with clip having a spring, where FIG. 7A is a rear view, and FIG. 7B is a close-up view, in accordance with an embodiment of the present invention.

DESCRIPTION

The present invention, referenced in FIGS. 1-7B, is directed to an automated reflective device 100 for monitoring a baby in a bassinet. The automated reflective device 100 enables viewing the interior of a bassinet from an outside vantage point. Those skilled in the art will recognize that the interior of a bassinet may contain a baby, a pet, or baby supplies. Thus, it is important to maintain vigilant monitoring inside the bassinet.

Figure 1:
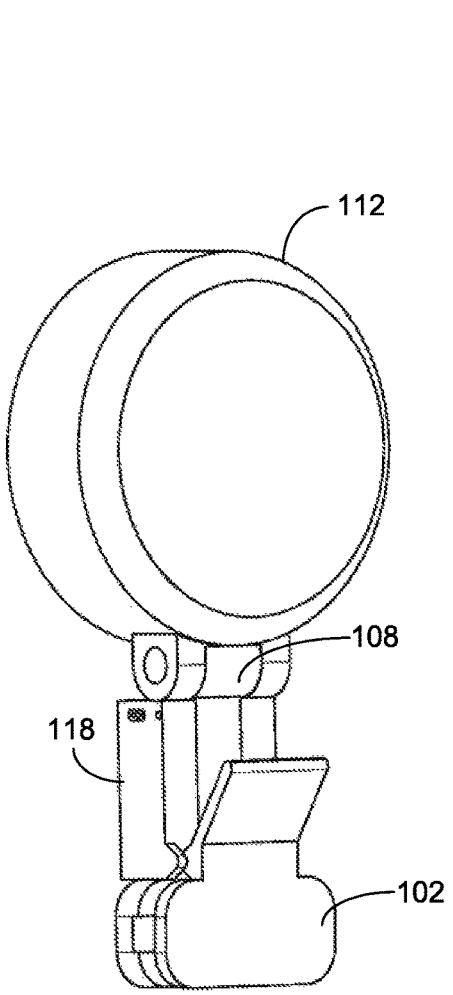
FIG. 1 is a rear perspective view of an exemplary automated reflective device, in accordance with an embodiment of the present invention.
Figure 2:
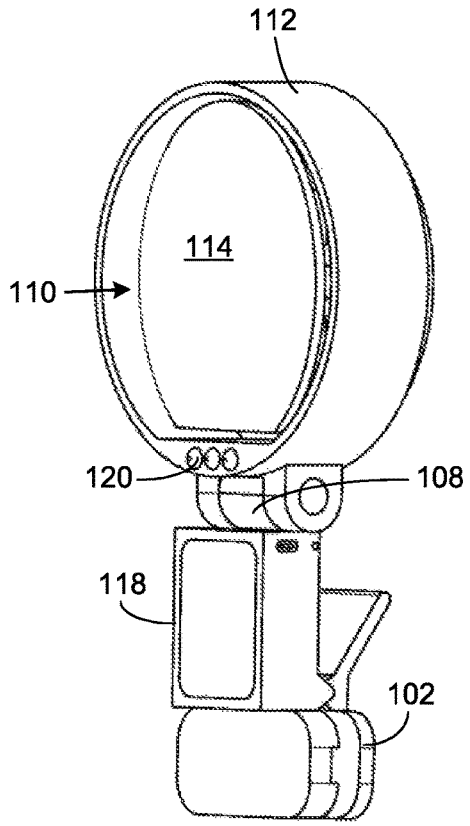
FIG. 2 is a front perspective view of the automated reflective device, in accordance with an embodiment of the present invention.

As referenced in FIGS. 1 and 2, the automated reflective device 100 for monitoring a baby in a bassinet, hereafter, "device 100", comprises a clamp 102 that detachably attaches the device 100 to a mounting surface on the bassinet. The device 100 further includes a reflector 110 that can be oriented in a variety of horizontal, vertical, swiveling, and telescoping directions to provide an optimal line of site into the bassinet.

The reflector 110 has a housing 112 and a reflective panel 114 made of a non-glass substrate overlaid with a reflective coating. The reflective panel 114 is oriented in relation to the bassinet, so as to reflect the interior contents of the bassinet from an external vantage point. A motor 118 powers an actuator in the housing 112.

Figure 3:
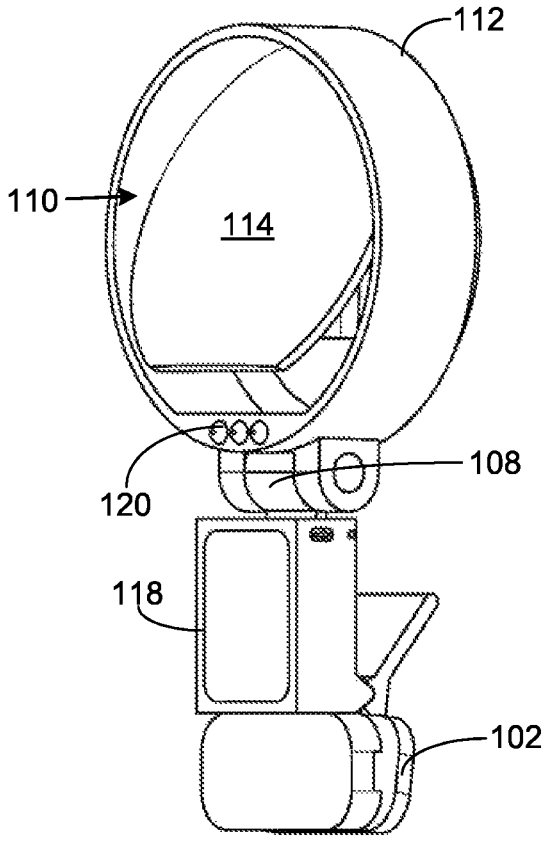
FIG. 3 is a front perspective view of the automated reflective device, showing an exemplary reflector tilted up, in accordance with an embodiment of the present invention.
Figure 4:
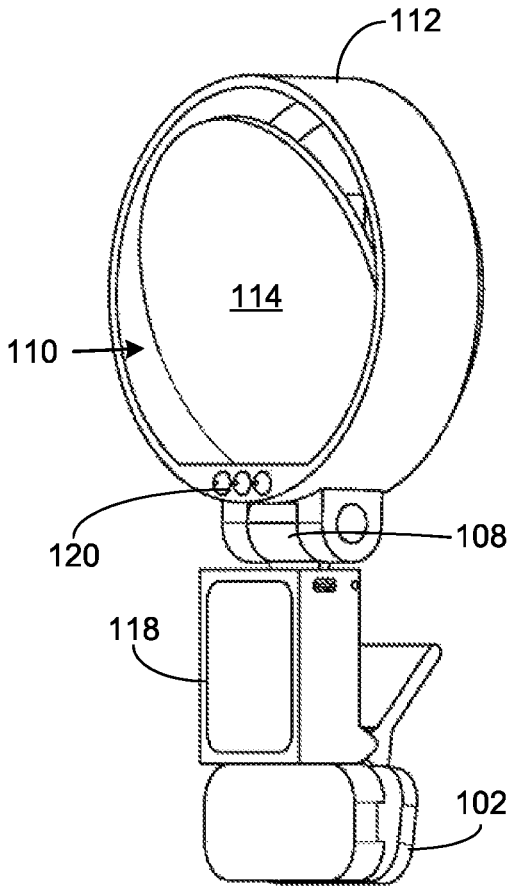
FIG. 4 is a front perspective view of the automated reflective device, showing an exemplary reflector tilted down, in accordance with an embodiment of the present invention.

The actuator adjustably moves the reflector 110 in the aforementioned horizontal, vertical, swiveling direction. In some embodiments, the actuator may also generate a telescoping, in and out movement of the reflector 110. FIGS. 3 and 4, for example, illustrates the reflector 110 pivoting up and down, so as to provide an enhanced line of sight inside the bassinet.

In some embodiments, a light emitting diode 120 (LED) positions on the front side of the housing 112. The LED is configured to illuminate a cool-white light inside the bassinet and on the reflective surface for enhanced viewing. A remote control operates the actuator, the LED 120, and the powering on and off the device 100.

As discussed above, the device 100 enables viewing the interior contents of a bassinet, i.e., baby, from an outside vantage point. The device 100 may be remotely oriented in a swiveling, lateral, and vertical direction to provide the optimal line of site into the bassinet.

In some embodiments, the device 100 includes a reflector 110 that detachably attaches to the bassinet. A clamp 102 may be used to attach to a mounting surface on the bassinet, such as the edges or head cover. The clamp 102 may include a spring 116 that biases the clamp 102 to form an inward pressure for secure fastening of the device 100 to a portion of the bassinet. Though, in other embodiments, the clamp 102 may use a threaded rod and a nut to threadably tighten the clamp 102 onto the bassinet. The clamp 102 may have a textured surface, such as a rubber panel, that grips onto the bassinet for enhanced fastening.

Figure 5A:
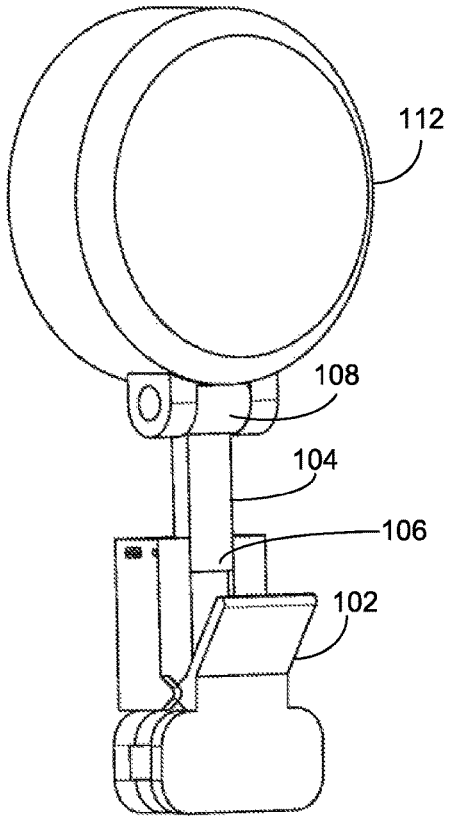
FIGS. 5A and 5B are perspective views of the automated reflective device with an exemplary handle extended, where
Figure 5B:
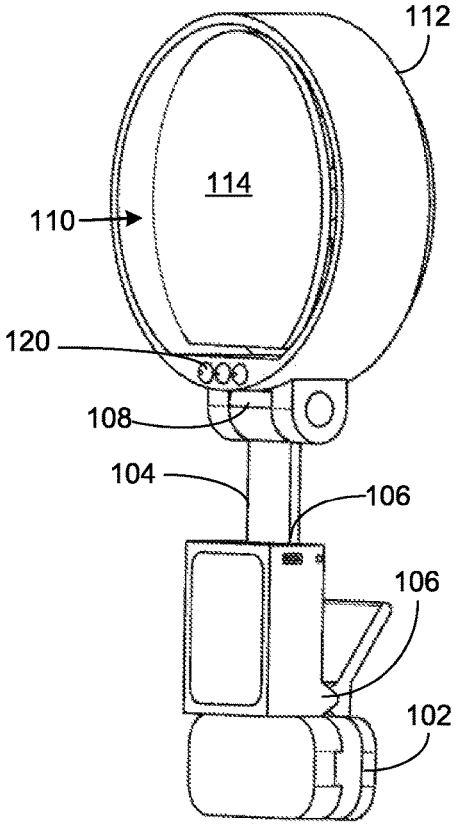

Turning now to FIGS. 5A and 5B, a handle 104 extends between the clamp 102 and the reflector 110. The handle 104 has a mount end 106 and a reflect end 108. The mount end 106 fixedly attaches to the clamp 102. The reflect end 108 joins with the reflector 110. The handle 104 may be linear or jointed for enabling additional reorientation and adjustability for the reflector 110. The handle 104 extends and retracts to a desired length, as needed. In one embodiment, the handle 104 is fabricated from metal, and be approximately 6" long. Though other dimensions and materials are possible. For example, a resilient handle 104 that bends in multiple directions may be used.

Looking now at FIGS. 6A and 6B, the reflect end 106 of the handle 104 pivots up and down to a desired orientation. The pivoting action enables the reflector 110 to be adjusted as needed. For example, FIG. 6C illustrates a front view of the reflect end 106 hinged and pivoted downwardly. The hinge may include a pin and a hinge case. Though other pivoting mechanisms may be used in other embodiments.

The device 100 further includes a reflector 110 that reflects the interior of the bassinet for external viewing. The reflector 110 may include a housing 112 and a reflective panel 114. The housing 112 forms a protective, rigid cover for protecting components that operate the device 100 from moisture, shocks, and dust. The housing 112 may be shaped in a circular shape, a rectangular shape, a cubicle shape, or a pyramid shape.

The reflective panel 114 is the actual surface that shows the reflection. The reflective panel 114 reflects light from inside the bassinet in such a way that, for incident light in some range of wavelengths, the reflected light preserves many or most of the detailed physical characteristics of the original light. In essence, the reflective panel 114 serves as a mirror. However, the reflective panel 114 utilizes a non-glass substrate overlaid with a reflective coating. Since the reflective panel 114 is not a mirror, it is generally not prone to breakage.

In one embodiment, the reflective panel 114 is a plastic convex mirror. However, in other embodiments, the reflective panel 114 may include, without limitation, a flat panel, a convex panel, and an aspheric panel. Any combination of the panels may be used. In one alternative embodiment, the reflective panel 114 may have both a curved profile and an adjacently disposed flat profile, so as to provide the optimal viewing angles. Those skilled in the art will recognize that curved mirrors may be used as the reflective panel 114 to produce magnified or diminished images, focus light, or distort the reflected image.

The reflector 110 is oriented in relation to the bassinet, so as to reflect the interior contents of the bassinet for viewing from an external vantage point. Those skilled in the art will recognize that this external observation capacity is important because often, the line of site directly into the bassinet is restricted by an object or the bassinet itself.

For example, a mother lying in bed is elevated lower than the bassinet on the dresser. The line of site is below the opening in the bassinet, such that the mother cannot see the baby inside while lying on the bed. To enable viewing inside the bassinet, the reflector 110 may be oriented upwardly and swiveled in a first direction, so as to reflect the baby inside the bassinet. For additional convenience, the reflector 110 may be adjustable oriented with a remote control 122.

In another example, a plurality of bassinets in a hospital containing newly born babies may not provide a line of sight inside each bassinet. Consequently, the nurse inside a nurse station does not have the proper angle for viewing all of the babies, and is therefore forced to physically walk to the bassinets. The device 100 enables the nurse to clamp 102 a device 100 to each bassinet, and then adjust each reflector 110 to the desired angle and orientation. In this manner, the nurse can see all of the babies from inside the nurse station.

In some embodiments, the LED 120 illuminates a cool-white light onto the reflector 110 and the interior of the bassinet to enhance visibility of the reflection. The LED 120 is especially effective because it does not generate a glaring light that may disturb the baby, but rather generates a cool-white light. The cool-white is also configured to generate nominal heat, which may overheat the baby or ignite a fire. The LED 120 also consumes minimal energy, such that the power source does not expire excessively fast.

To achieve the optimal line of site from outside the bassinet, the system utilizes an actuator that is disposed inside the housing 112 of the reflector 110. The actuator is configured to manipulate the reflector 110 in multiple orientations. The actuator may include, without limitation, a geared motor, a Bowden cable, a gear, a lever, and a ball and socket. A small motor 118 powers the actuator. The motor 118 may include a small 12 volt electrical motor. Though other types of motors 118 may be used. For example, without limitation, a 6 or 9 volt electrical motor. A power source provides energy to the motor 118 and the LED 120. The power source may include, without limitation, a 3 volt core cell, a lithium battery, and a solar panel.

Looking back at FIG. 5A and FIG. 6A, the actuator moves the reflector 110 in a vertical, or up and down direction. In another embodiment, the actuator moves the reflector 110 in a horizontal, or left and right direction. In yet another embodiment, the actuator swivels the reflector 110, which may include a 360° rotational direction. In one alternative embodiment, that may or may not be used, the actuator moves the reflector 110 telescopically in an outward and inward direction. In this manner, the reflector 110 may be oriented at multiple angles to obtain the desired line of site into the bassinet.

The device 100 includes a remote control that remotely controls movement of the actuator. The remote control also operates the LED 120 and powers on and off the device 100. The remote control has a transmitter that transmits a signal to a receiver in the housing 112. The receiver is operatively connected to the actuator and the light emitting diode.

The signal may include an infra-red light signal. Though any number of wavelengths may be used to transmit the signal. The signal is operable to command movement of the actuator, illumination of the LED 120, and powering on and off of the device 100. The remote operation of the device 100 provides convenience and additional safety while monitoring the baby in the bassinet.

As referenced in FIG. 7A, a clamp 102 is used to attach to a mounting surface on the bassinet, such as the edges or head cover. The clamp 102 may include a spring 116 that biases the clamp 102 to form an inward pressure for secure fastening of the device 100 to a portion of the bassinet (FIG. 7B). The clamp 102 may have a textured surface, such as a rubber panel, that grips onto the bassinet for enhanced fastening.

While the inventor's above description contains many specificities, these should not be construed as limitations on the scope, but rather as an exemplification of several preferred embodiments thereof. Many other variations are possible. For example, the reflective panel 114 may use a combination of different reflective panel surfaces in the same reflector, such as a flat panel adjacent to a convex panel. Accordingly, the scope should be determined not by the embodiments illustrated, but by the appended claims and their legal equivalents.

What is claimed is:

1. An automated reflective device for monitoring a baby in a bassinet, the device comprising:

a clamp, the clamp configured to enable detachable mounting;

a handle, the handle having a mount end and a reflect end, the mount end configured to join with the clamp;

a reflector, the reflector having a housing and a reflective panel, the housing configured to join with the reflect end of the handle, the reflective panel defined by a non-glass substrate overlaid with reflective coating;

a light emitting diode, the light emitting diode disposed externally to the housing, the light emitting diode configured to emit a light towards the general proximity of the reflective panel;

an actuator, the actuator disposed inside the housing, the actuator configured to move the reflector in a horizontal direction, the actuator further configured to move the reflector in a vertical direction, the actuator further configured to swivel the reflector, wherein the movements by the reflector form a line of sight with the reflective panel;

a motor, the motor configured to power the actuator;

a power source, the power source configured to provide energy to the light emitting diode and the motor;

a receiver, the receiver configured to operatively connect to the actuator and the light emitting diode; and a remote control, the remote control having a transmitter, the transmitter configured to emit a signal to the receiver, wherein the received signal is operable to command the actuator to manipulate the reflector, the motor, and the light emitting diode.

2. The device of claim 1, wherein the device is configured to operate with a bassinet.

3. The device of claim 2, wherein the clamp has a spring.

4. The device of claim 3, wherein the spring in the clamp is configured to bias the clamp to apply an inward pressure for detachably fastening to the bassinet.

5. The device of claim 4, wherein the clamp has a textured surface.

6. The device of claim 5, wherein the textured surface is configured to grip a portion of the bassinet for detachable mounting of the device.

7. The device of claim 1, wherein the handle is substantially linear.

8. The device of claim 1, wherein the handle is fabricated from metal.

9. The device of claim 1, wherein the handle is about six inches long.

10. The device of claim 1, wherein the reflective panel includes at least one member selected from the group consisting of: a flat panel, a convex panel, and an aspheric panel.

11. The device of claim 1, wherein the light emitting diode is a two-lead semiconductor light source.

12. The device of claim 1, wherein the light that is emitted by the light emitting diode is a cool white light.

13. The device of claim 1, wherein the actuator is configured to telescopically extend and retract the reflector.

14. The device of claim 1, wherein the actuator includes at least one member selected from the group consisting of: a geared motor, a Bowden cable, a gear, a lever, and a ball and socket.

15. The device of claim 1, wherein the motor is a 9 volt or a 12 volt electrical motor.

16. The device of claim 1, wherein the power source is a 3 volt core cell.

17. The device of claim 1, wherein the signal emitted by the transmitter is an infra-red light.

18. The device of claim 1, wherein the remote control has a horizontal switch, a vertical switch, a swivel switch, a light switch, and a power switch.

19. An automated reflective device for monitoring a baby in a bassinet, the device comprising:

a clamp, the clamp having a spring, the spring configured to bias the clamp to exert an inward force for detachable mounting;

a handle, the handle having a mount end and a reflect end, the mount end configured to join with the clamp; a reflector, the reflector having a housing and a reflective panel, the housing configured to join with the reflect end of the handle, the reflective panel defined by a non-glass substrate overlaid with reflective coating, the reflective panel further defined by a curved profile adjacently positioned to a flat profile;

a light emitting diode, the light emitting diode disposed externally to the housing, the light emitting diode configured to emit a cool-white light towards the general proximity of the reflective panel;

an actuator, the actuator disposed inside the housing, the actuator configured to move the reflector in a horizontal direction, the actuator further configured to move the reflector in a vertical direction, the actuator further configured to swivel the reflector, the actuator further configured to telescopically extend and retract the reflector, wherein the movements by the reflector form a line of sight with the reflective panel;

an electric motor, the electric motor configured to power the actuator;

a battery, the battery configured to provide energy to the light emitting diode and the electric motor;

a receiver, the receiver configured to operatively connect to the actuator and the light emitting diode; and a remote control, the remote control having a transmitter, the transmitter configured to emit an infra-red light signal to the receiver, wherein the received infra-red light signal is operable to command the actuator to manipulate the reflector, the motor, and the light emitting diode.

* * * * *